US007314222B2

(12) United States Patent
Borel et al.

(10) Patent No.: US 7,314,222 B2
(45) Date of Patent: Jan. 1, 2008

(54) ADJUSTABLE SKATE

(76) Inventors: René Borel, Les Prés Grenier, 74540 Saint Sylvestre (FR); Thierry Miralles, Le Faubourg, 74150 Marcellaz Albanais (FR)

( * ) Notice: Subject to any disclaimer, the term of this patent is extended or adjusted under 35 U.S.C. 154(b) by 0 days.

(21) Appl. No.: 10/857,007

(22) Filed: Jun. 1, 2004

(65) Prior Publication Data

US 2004/0239057 A1 Dec. 2, 2004

(30) Foreign Application Priority Data

Jun. 2, 2003 (FR) ..... 03 06617

(51) Int. Cl.
*A63C 1/26* (2006.01)

(52) U.S. Cl. ..... 280/11.26; 280/841; 36/97; 36/117.7

(58) Field of Classification Search ..... 280/11.26, 280/11.16, 11.27, 11.28, 11.12, 11.19, 11.221, 280/7.13, 841, 843, 844, 11.211; 36/97, 36/117.7, 117.8; *A63C 1/22, 17/02, 17/04, A63C 17/06, 17/18; A43B 3/26, 5/16*
See application file for complete search history.

(56) References Cited

U.S. PATENT DOCUMENTS 2,060,578 A * 11/1936 Kees ..... 280/11.26
2,067,712 A * 1/1937 Knapp ..... 280/11.26
3,309,098 A * 3/1967 Parker ..... 280/11.26
3,993,318 A * 11/1976 Rothmayer ..... 280/11.26
4,657,265 A * 4/1987 Ruth ..... 280/7.13
4,666,169 A * 5/1987 Hamill et al. ..... 280/11.223
4,836,571 A * 6/1989 Corbisiero ..... 280/600
5,484,149 A * 1/1996 Lee ..... 280/11.26
5,498,009 A * 3/1996 Young ..... 280/11.12
5,682,687 A * 11/1997 Arai ..... 36/97
5,794,362 A * 8/1998 Polk et al. ..... 36/97
5,836,592 A * 11/1998 Chang ..... 280/11.26
5,890,723 A 4/1999 Benoit
6,216,365 B1 * 4/2001 Cohen ..... 36/44
6,276,697 B1 * 8/2001 Lin ..... 280/11.26
6,497,420 B2 * 12/2002 Ricci ..... 280/11.16
6,547,261 B2 4/2003 Gorza et al.
6,612,592 B1 * 9/2003 Soo ..... 280/11.16
6,648,346 B2 11/2003 Borel
6,698,768 B2 * 3/2004 Chun-Cheng et al. ... 280/11.19
6,863,284 B2 * 3/2005 Wegener ..... 280/11.231
6,916,027 B2 * 7/2005 Chen ..... 280/11.26
6,918,602 B2 * 7/2005 Lu ..... 280/11.26

(Continued)

FOREIGN PATENT DOCUMENTS

EP 1 112 698 A2 7/2001

(Continued)

*Primary Examiner*—Christopher P. Ellis
*Assistant Examiner*—John D Walters
(74) *Attorney, Agent, or Firm*—Greenblum & Bernstein, P.L.C.

(57) ABSTRACT

A skate having a base adapted to support a user's boot, a frame equipped with a plurality of wheels and having a transverse arch in its central portion, at least one rear quarter capable of sliding on the base and adapted to surround the heel zone and the lower leg of the boot. The base has two edges that project upwardly and surround the lower portion of the rear quarter, each of the vertical edges having a longitudinal groove capable of receiving a platform provided on the outer sides of the rear quarter, and attaching mechanism allowing the attachment of the rear quarter to the base in various positions.

21 Claims, 5 Drawing Sheets

U.S. PATENT DOCUMENTS

| | | | | |
|---|---|---|---|---|
| 2002/0125658 | A1* | 9/2002 | Alwarid | 280/11.211 |
| 2005/0055847 | A1* | 3/2005 | Piva et al. | 36/97 |
| 2005/0057008 | A1* | 3/2005 | Yiu Lu | 280/11.26 |
| 2005/0093256 | A1* | 5/2005 | Hsieh | 280/11.231 |

FOREIGN PATENT DOCUMENTS

| | | |
|---|---|---|
| FR | 2 804 878 A1 | 8/2000 |

* cited by examiner

ADJUSTABLE SKATE

CROSS-REFERENCE TO RELATED APPLICATION

BACKGROUND OF THE INVENTION

1. Field of the Invention

The invention relates to skates, particularly inline roller skates, specifically those provided to perform acrobatic figures, called "aggressive" skates, and which are provided to be used with independent sports boots.

2. Description of Background and Relevant Information

One of the figures commonly executed with skates of the aforementioned type involves performing a transverse sliding maneuver by using the central zone of the skate as a sliding surface.

It is known to equip the frame of a skate with a transverse arch that defines the central sliding surface of the skate. Indeed, since transverse slidings, or grinds, mostly occur on rails or edges, the latter get nested in the arch and thus wedge the skate in a defined longitudinal position. Current skates do not permit the skater to vary the position of the skater's heel with respect to the transverse arch.

SUMMARY OF THE INVENTION

An object of the present invention is to make it possible to vary the relative position of the user's heel and the transverse arch of the skate.

An additional object of the invention is to allow the skater to use different boots/shoes with the same aggressive skate while allowing him/her to maintain the same adjustment of relative positioning between his/her heel and the transverse arch of the skate.

An object of the present invention also is to improve the skater's comfort and protection when engaged in aggressive skating.

An object of the present invention is also to improve the lateral stability of the skater's heel on a skate having an independent boot.

An object of the present invention is also to improve the lateral stability of the adjustable elements in the direction of the length of the skate.

These various objects are achieved by providing a skate according to the limitations presented in the claims below.

In particular, these various objects are achieved by providing a skate adapted to receive the user's boot, which boot has a sole and a heel zone, which skate has a base adapted to support the boot, which base has a lateral edge and a medial edge, each of these edges extending vertically upward and having a longitudinal groove provided in the inner surface of the edge; a rear quarter capable of sliding on the base and adapted to surround the heel zone of the boot, the rear quarter having a lower portion, the lower portion having a runner on each of the lateral and medial sides thereof; and a mechanism to permit the attachment of the rear quarter to the base in any of various positions. In the skate according to the invention, the medial and lateral edges surround the lower portion of the rear quarter and the runners slide in the grooves.

The skate according to the invention is capable of receiving an independent sports boot, i.e., not specifically designed for the skate. Regardless of the type of sole on the boot, i.e., for instance, a substantially overlapping sole or a recessed sole, the user can adjust the position of the rear quarter with respect to the central arch. Likewise, the same skate base according to the invention can be used by persons having different shoe sizes.

In the skate according to the invention, the rear quarter that is adjustable in length has two runners that project from the widest part of the lower portion of the rear quarter. These runners are maintained inside grooves provided in the vertical edges of the base, which has the effect of optimizing the lateral and longitudinal stability of the rear quarter on the base.

BRIEF DESCRIPTION OF DRAWINGS

The invention will be better understood and other characteristics thereof will become apparent from reading the following description and from the attached drawing, in which.

DETAILED DESCRIPTION OF THE INVENTION

Figure 1:
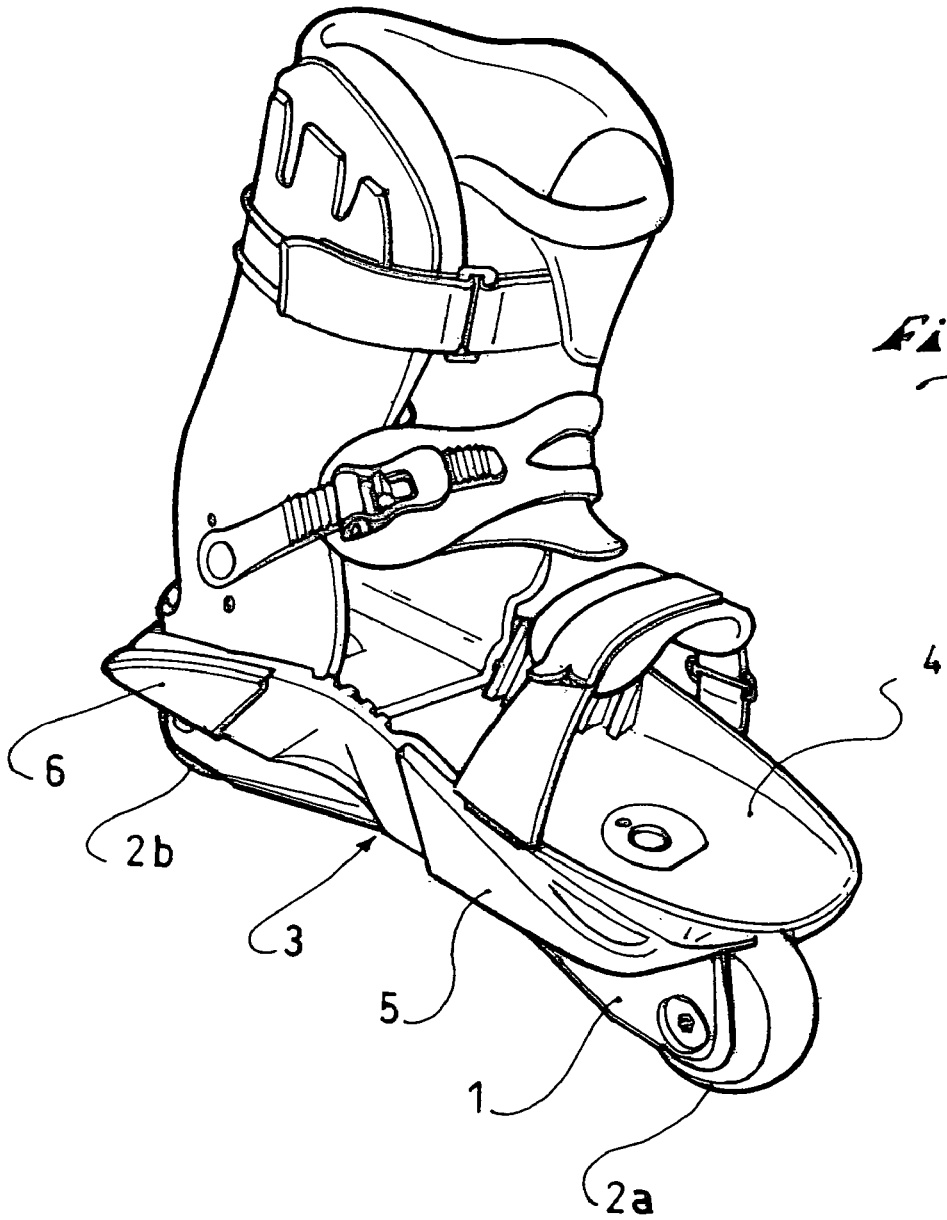
FIG. 1 shows a perspective view of a skate according to the invention.

FIG. 1 shows a perspective view of the roller skate according to the invention. The skate includes a frame 1 which has a substantially longitudinal structure, at the two ends of which two wheels 2*a*, 2*b* are attached. The choice of a two-wheel frame, as shown, is not limiting to the invention. Therefore, the invention encompasses a frame having three, four, or more wheels, inline or not. Between the two wheels 2*a*, 2*b*, the frame 1 has the form of an arch 3, whose concavity faces downwardly. This arch is used as a sliding surface for transverse slidings or grinds. Because of its amplitude, between the two wheels and its substantial radius of curvature, the arch allows sliding in multiple directions. Reference is always made to transverse sliding although, with the longitudinal axis of the skate, the direction of sliding can be described as making an angle less than 45° A base 4 is attached to the frame by means of two screws positioned in the median plane of the frame and separated from each other by a distance of 167 millimeters (mm).

Figure 3:
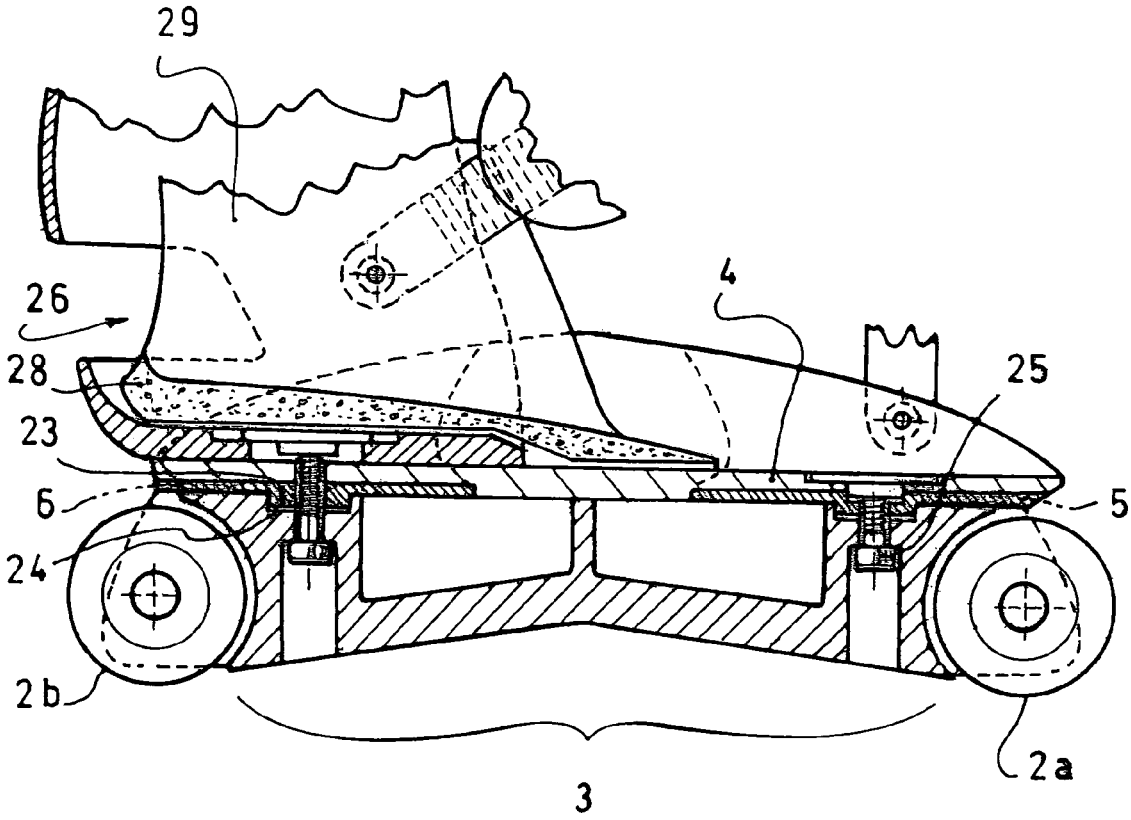
FIG. 3 shows a view of the skate in a longitudinal cross-section.

As can be seen in FIG. 3, the upper surface of the frame 1 on which the base 4 rests has two recesses 24. Each of these recesses is centered on the holes for the passage of the two screws and are adapted to receive corresponding bosses originating from the base 4. The connection between the frame 1 and the base is in conformance with the UFS standard, such standard being described in French Patent Publication No. 2 804 878 and in U.S. Pat. No. 6,648,346, the disclosure of the latter of which is hereby incorporated by reference thereto in its entirety.

The base 4 is equipped with two sliding shoes. The front sliding shoe 5 and the rear sliding shoe 6 are made from a material that promotes sliding, such as, for instance, a DELRIN® type polyacetal. This choice is not limiting to the invention and any other material can be used, depending on the sliding properties sought. For example, one can choose a material whose sliding properties are better than those of the materials used for the base and/or for the frame.

Figure 2:
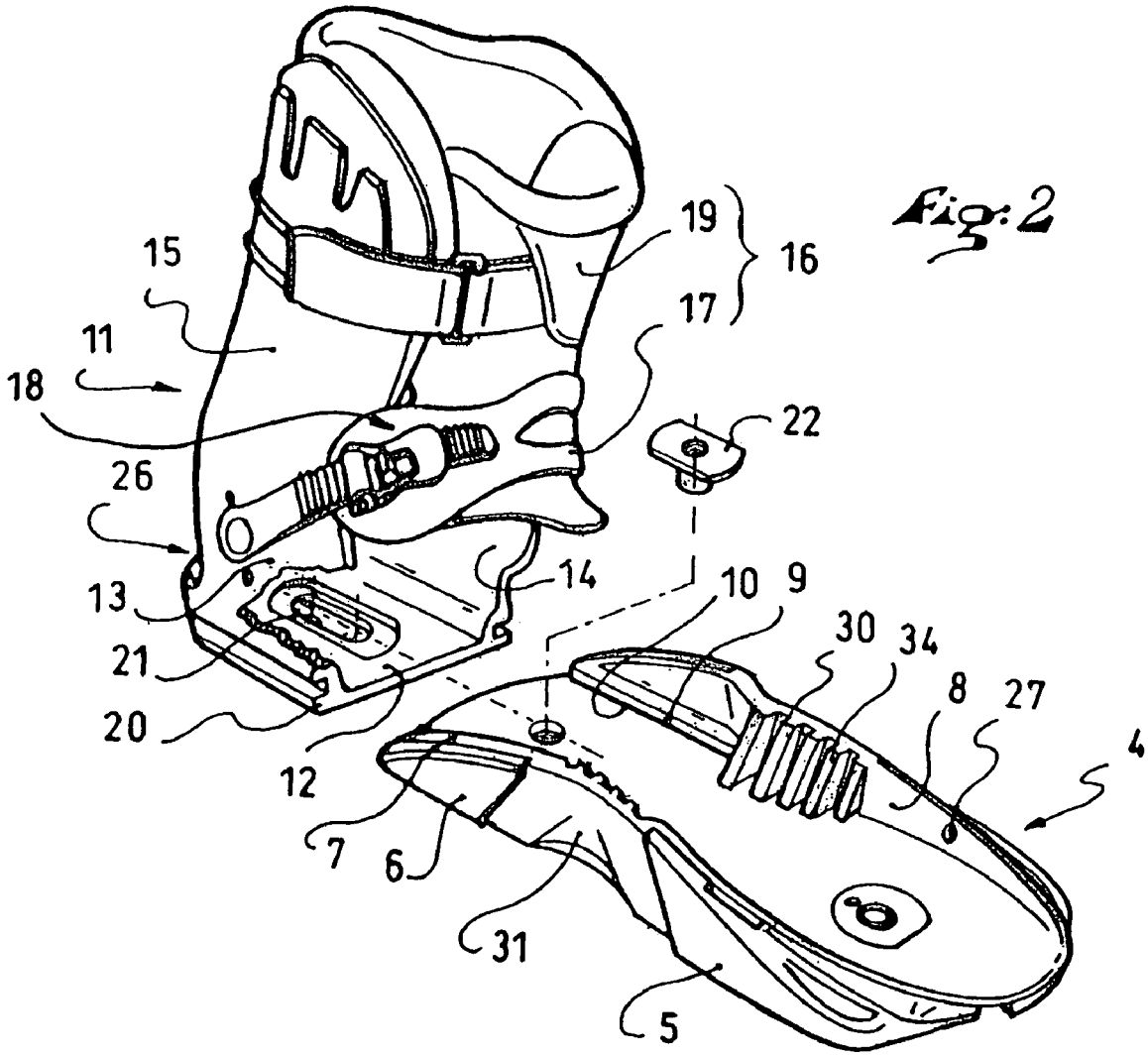
FIG. 2 shows a perspective view of the base and of the rear quarter in the disassembled position.

The base 4, shown in perspective in FIG. 2, has two vertical, or substantially vertical, edges. The medial edge 8 extends upwardly from the side of the base 4 over the entire length thereof, or substantially the entire length thereof. The central portion of the medial edge 8 is higher than the ends and, on its inner surface, has a support structure 34 in the form of stiffening ribs and, on its outer surface, a concave medial sliding surface 30 that can be used as a sliding surface in the extension of the arch of the frame. The support structure 34 can take a form other than that of the stiffening rib, such as, for instance, that of a thickening or of a convex arch overlapping inward of the base and providing plantar arch support. In the rear portion of the medial edge 8, a longitudinal rib 9 is provided at the base of its inner surface. This rib 9 is parallel to the base 4 such that a groove 10 is thus defined between the rib 9 and the bottom of the base 4. The front portion of the lateral edge 7 is equipped with fastening device 27 for attaching the front attachment for attaching the boot to the skate.

The lateral edge 7 is similar to the medial edge 8, with support structure positioned in the central portion thereof, at the rear of a concave lateral sliding surface 31. It also has a longitudinal rib defining a groove. The concave lateral sliding surface 31 provided on its outer surface is substantially less recessed than the one provided on the medial edge. The central zone of the lateral edge and of the medial edge has a more substantial elevation than the front and rear zones thereof, respectively.

The front and rear sliding shoes 5, 6 have vertical or upstanding portions that cover the front and rear portions of the lateral and medial edges. In this way, they promote the longitudinal sliding not only on surfaces on which the lower surface of the base is supported, but also along vertical edges and surfaces.

Figure 4:
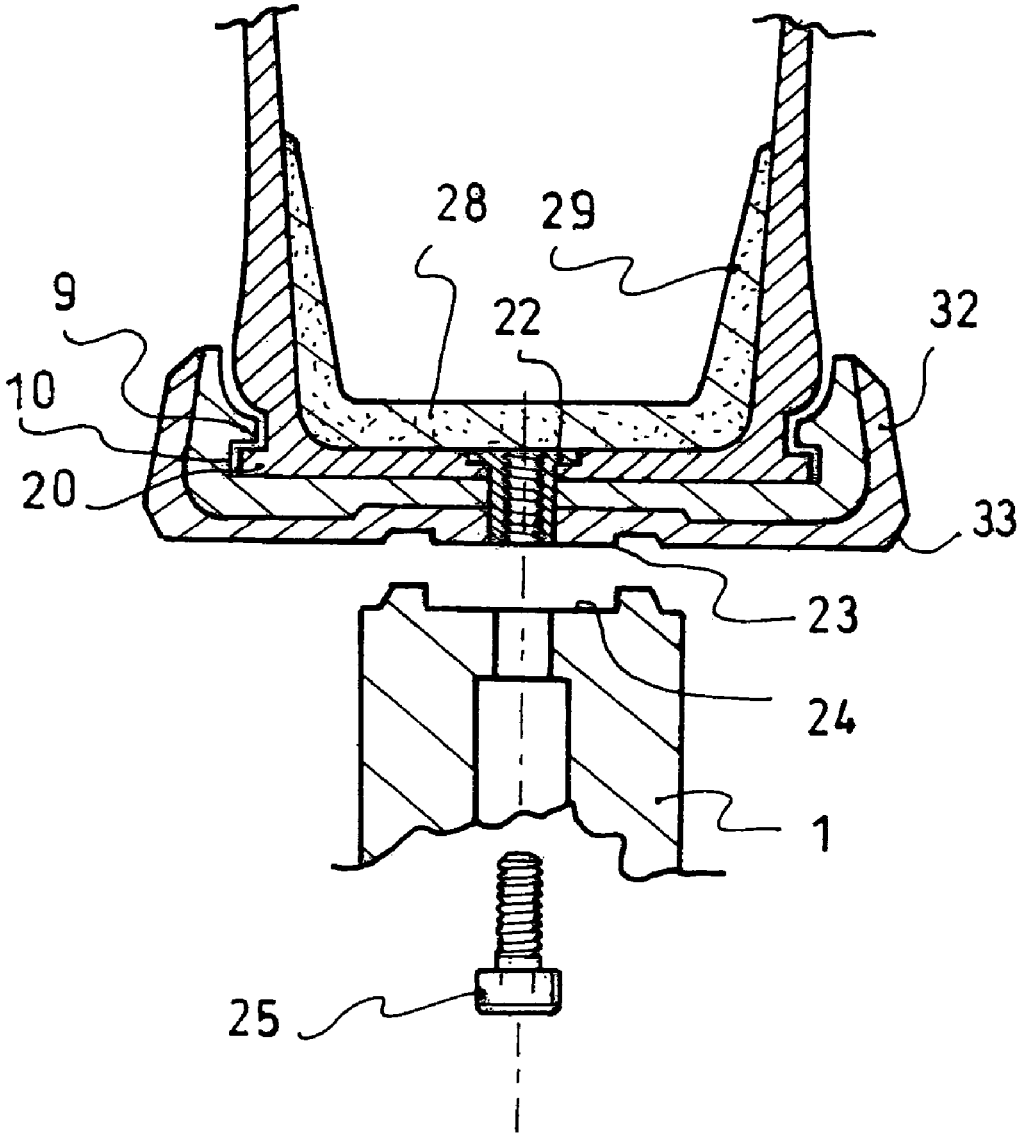
FIG. 4 shows a transverse cross-section.

FIG. 4 shows the cross-section of the rear sliding shoe 6 and of the vertical upstanding portions, or risers, 32 that cover the lateral and medial edges of the base 4. The sliding shoes 5, 6 further have a beveled surface 33, in the area of the edge, separating their horizontal sliding surface from the substantially vertical sliding surfaces. This beveled surface 33 is on each of the front and rear shoes, and on each of the lateral and medial sides, and it defines new gliding planes that, together with the usual horizontal sliding planes, form an angle between 30° and 60°, or between approximately 30° and approximately 60°.

The rear quarter 11 has a lower portion 12 supported on the rear portion of the base 4. Originating from the lower portion 12 of the rear quarter 11 are an upstanding lateral member 13 and an upstanding medial member 14. These upstanding members serve to anchor the mechanisms for attaching the instep girth of the boot to the skate on both sides. To the rear of these upstanding members 13 and 14, the rear quarter has a wide opening 26. This wide opening 26 promotes the positioning of independent boots in the skate without the possible overlaps of the sole or the heel stiffener of the latter preventing the optimal positioning of the user's foot and lower leg. Above these upstanding members 13, 14 the rear quarter is extended by a sleeve 15 adapted to envelop and maintain the user's lower leg. The sleeve 15 covers the lateral, medial, and posterior surfaces of the lower leg, whereas the anterior surface is maintained by the upper portion of the strap/tongue 16. In the illustrated embodiment, the rear quarter 11, i.e., lower portion 12, lateral and medial members 13, 14, and the sleeve 15, are made in one-piece. The strap/tongue 16 is composed of a lower portion, the strap 17, whose function is to distribute the stresses of tightening the instep girth. It is connected to the medial upstanding member 14 by means of an adjustable strap (not seen in FIG. 1) and to the lateral upstanding member 13 by means of a notched strap allowing the tightening at will due to a ratchet mechanism 18. The upper portion of the strap/tongue 16 constitutes a tongue 19 whose rigid element is connected to the reinforcement of the strap 17. The skate shown in FIG. 1 includes a front strap and a rear strap for tightening the independent boot to the skate, the aforementioned strap 17 constituting the rear strap.

The lower portion 12 of the rear quarter 11 is provided, on each of its lateral and medial outer surfaces, with a longitudinal runner 20 provided to slide inside of the grooves 10. The runners project outwardly from the lower portion 12 of the rear quarter 11 in the area where the lower portion of the rear quarter is the widest. In this way, the lateral stability of the lower portion 12 of the rear quarter on the base 4 is optimized and, as a result, the inclinations to the sides of the skater's lower leg do not risk causing the edges of the rear quarter 11 to come unglued. The stability in flexion either forwardly or rearwardly of the lower portion 12 of the rear quarter 15 also optimized by the longitudinal extension of the runners 20.

FIG. 4 shows a partial cross-sectional view of a skate according to the invention. The lower portion 12 of the rear quarter 11 is maintained in the base 4 by the runners 20, which are capable of sliding in the grooves 10 provided in the edges of the base 4. As can be seen in FIG. 4, the base 4 has a generally U-shape, with the upstanding legs of the U-shape bearing the inwardly protecting ribs 9 and, within the upstanding legs, the grooves 10 receive the runners 20 of the lower portion 12 of the rear quarter 11. A slot 21 traverses the bottom of the lower portion 12 of the rear quarter 11. This slot 21 receives a nut washer 22. The nut washer can slide in the slot but it is blocked in rotation. The rear shoe 6 envelops the major portion of the rear portion of the lower portion 12 of the rear quarter 11, and the boss 23, adapted to cooperate with the recess 24 provided in the upper surface of the frame 1, is made from the shoe 6. Also made in the rear shoe 6 is a portion of the groove whose edges are in contact with the upper sides of the frame.

The adjustment of the rear quarter 12 to the desired position occurs by simply unscrewing the screw 25, then by sliding the rear quarter, and finally by retightening the screw. Means for locating the relative positions of the rear quarter 11 and the base 4 are provided on one of the vertical edges and on the lower portion 12 of the rear quarter 11. Advantageously, the rear screw 25 that attaches the frame 1 to the base 4 according to the UFS standard is also used to block the translation of the rear quarter 11.

An adaptable shock absorbing wedge 28 is inserted inside of the rear quarter. It has a horizontal portion, with a thickness between 5 mm and 30 mm, or between about 5 mm and about 30 mm, and ensures the raising of the heel with respect to the user's forefoot. For this wedge, a sufficiently rigid foam type material is selected so that, throughout the use of the skate, there is no depression, and that the raising of the heel remains effective. The material is nonetheless shock absorbing in order to ensure a better comfort in jump landings. The periphery of the horizontal portion extends vertically so as to be a comfort lining for the lower portion of the rear quarter. In practice, the wedge 28 has two vertical wings 29 that cover the inside of the members 13 and 14. The members 13 and 14 are made from a rigid plastic material which can hinder the skater, even if he/she is already wearing an independent shoe and then inserts his/her foot into the skate according to the invention. Furthermore, the longitudinal extension of the wings is more substantial than that of these upstanding members, such that the latter extend beyond the members 13, 14. As can be seen in FIG. 3, the wings 29 extend forwardly and rearwardly beyond the members 13, 14. The portion of the wings that extend beyond the edges of the members 13, 14 prevent the edges from injuring the skater. In addition, the fact that these wings extend beyond the rises guarantees the skater a holding gradient between the zones in which his/her foot is firmly held by the rear quarter, and the zones in which the foot has no hold.

The vertical wings can be cut to accommodate the skate according to the invention to a boot having a wider sole. Similarly, when the skater would like to use the skate according to the invention with a boot whose upper is already provided with a padding material, the wings can be cut at their base.

Figure 5:
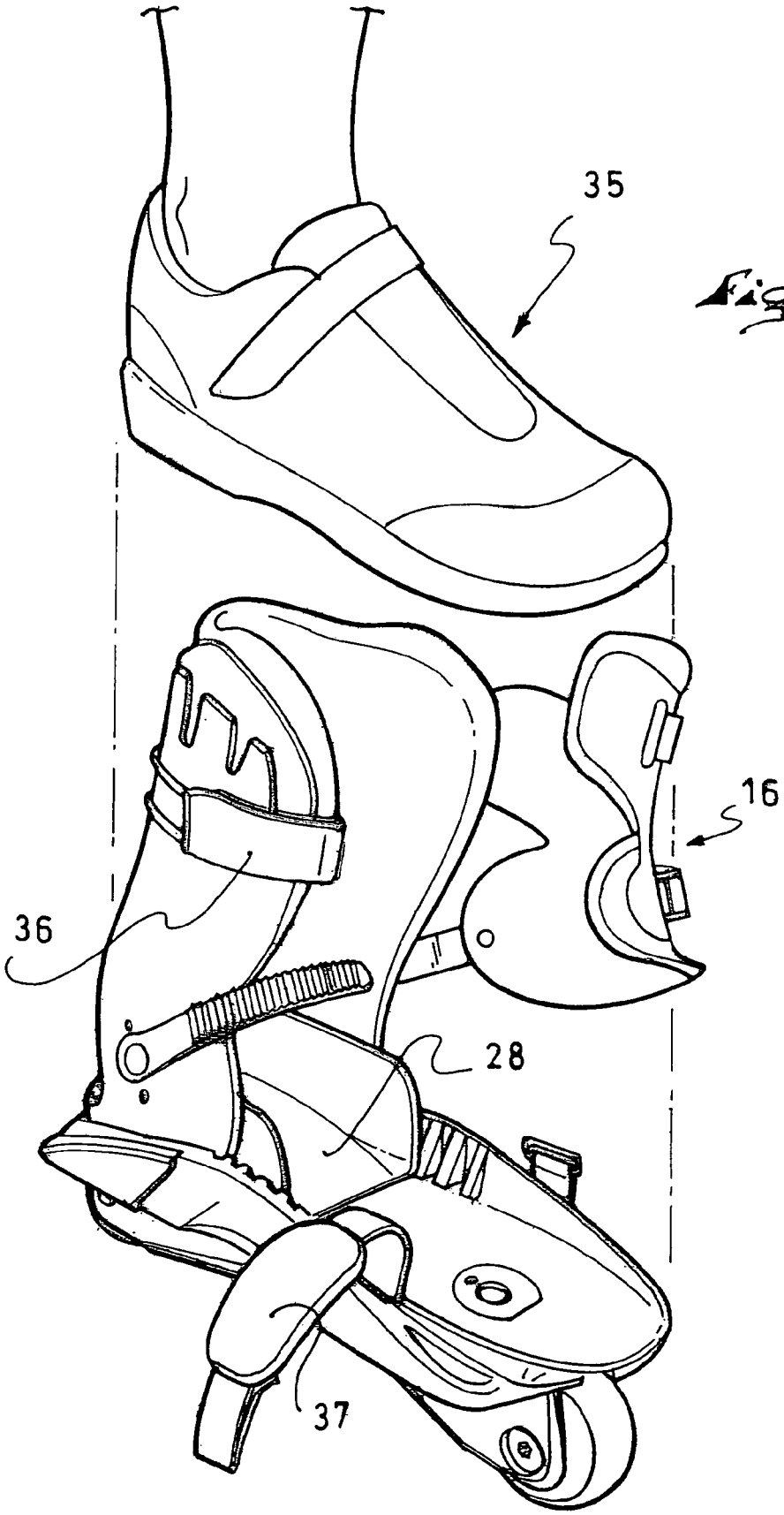
FIG. 5 shows a perspective view of the skate according to the invention, with the boot.

FIG. 5 shows the skate before insertion of the boot 35. All of the tightening mechanisms are open, i.e., the strap/tongue 16, the lower leg strap 36 as well as the forefoot strap 37. The skater can then insert his/her foot fitted with the boot 35 into the skate, then close and tighten the tightening mechanisms.

The embodiment is described herein by way of example, and the invention is not limited only to this single embodiment but applies to all equivalent embodiments. For instance, the fitting portion (base and rear quarter) that constitutes the context of the invention can be mounted on a skate having three or more wheels, whether this is an inline skate or not, or on a skate that is not specifically provided for executing acrobatic figures. It can also be mounted with a blade for an ice skate.

LIST OF REFERENCES

1 Frame
2*a*, 2*b* Wheels
3 Arch
4 Base
5 Front sliding shoe
6 Rear sliding shoe
7 Lateral edge
8 Medial edge
9 Rib
10 Groove
11 Rear quarter
12 Lower portion of rear quarter
13 Lateral upstanding member
14 Medial upstanding member
15 Sleeve
16 Strap/tongue
17 Strap
18 Ratchet mechanism
19 Tongue
20 Runner
21 Slot
22 Nut washer
23 Boss
24 Recess
25 Screw
26 Opening
27 Fastening mechanism
28 Shock absorbing wedge
29 Wing
30 Medial concave sliding surface
31 Lateral concave sliding surface
32 Vertical rise
33 Beveled surface
34 Support structure
35 Boot
36 Lower leg strap
37 Forefoot strap

What is claimed is:

1. A skate adapted to receive a user's boot, said boot having a sole and a heel zone, comprising:

a base adapted to support said boot, said base having an upwardly extending lateral edge and an upwardly extending medial edge, each of said edges including an inner surface having a longitudinal groove;

a rear quarter adapted to slide on the base and adapted to surround the heel zone of said boot, said rear quarter including a lower portion having lateral and medial sides, each of said lateral and medial sides having a longitudinally extending runner;

an attaching mechanism to attach the rear quarter to the base in any of a plurality of positions;

said medial and lateral edges of said base overlapping said lower portion of said rear quarter;

said runners of said lateral and medial sides of said lower portion of said rear quarter being slidably engaged in said grooves of said lateral and medial edges of said base.

2. A skate according to claim 1, further comprising:

a frame having an arch with a downwardly facing concavity;

the medial edge and the lateral edge of the base are equipped with a medial concave outer sliding surface and a lateral concave outer sliding surface, respectively, located directly above the arch of the frame.

3. A skate according to claim 2, wherein:

the edges are equipped with support structures in the area of the medial concave sliding surface and the lateral concave sliding surface, respectively.

4. A skate adapted to receive a user's boot, said boot having a sole and a heel zone, said skate comprising:

a base adapted to support said boot, said base having an upwardly extending lateral edge and an upwardly extending medial edge, each of said edges including an inner surface having a longitudinal groove;

a rear quarter adapted to slide on the base and adapted to surround the heel zone of said boot, said rear quarter including a lower portion having lateral and medial sides, each of said lateral and medial sides having a longitudinally extending runner;

an attaching mechanism to attach the rear quarter to the base in any of a plurality of positions;

said medial and lateral edges of said base overlapping said lower portion of said rear quarter;

said runners of said lateral and medial sides of said lower portion of said rear quarter being slidably engaged in said grooves of said lateral and medial edges of said base; and a sliding shoe located beneath the base at a front portion of the base and a sliding shoe located beneath the base at a rear portion of the base.

5. A skate adapted to receive a user's boot, said boot having a sole and a heel zone, comprising:

a base adapted to support said boot, said base having an upwardly extending lateral edge and an upwardly extending medial edge, each of said edges including an inner surface having a longitudinal groove;

a rear quarter adapted to slide on the base and adapted to surround the heel zone of said boot, said rear quarter including a lower portion having lateral and medial sides, each of said lateral and medial sides having a longitudinally extending runner;

an attaching mechanism to attach the rear quarter to the base in any of a plurality of positions;

said medial and lateral edges of said base overlapping said lower portion of said rear quarter;

said runners of said lateral and medial sides of said lower portion of said rear quarter being slidably engaged in said grooves of said lateral and medial edges of said base;

the rear quarter comprising an upstanding lateral wall and an upstanding medial wall; and a shock absorbing wedge positioned within the rear quarter, said wedge having a horizontal portion that ensures raising a heel with respect to the user's forefoot, and a periphery that extends upwardly to line the upstanding lateral and medial walls of said rear quarter.

6. A skate according to claim 5, wherein:

said periphery of the shock absorbing wedge has two wings that extend beyond said vertical walls of said rear quarter.

7. A skate according to claim 4, wherein:

the sliding shoe located beneath the base at a front portion of the base is a front sliding shoe, said front sliding shoe comprises a vertical sliding surface, a horizontal sliding surface, and a beveled surface between the horizontal sliding surface from the vertical sliding surface;

the sliding shoe located beneath the base at a rear portion of the base is a rear sliding shoe, said rear sliding shoe comprising a vertical sliding surface, a horizontal sliding surface, and a beveled surface between the horizontal sliding surface from the vertical sliding surface; and said beveled surface of each of said front and rear sliding shoes forms an angle between 30° and 60° with a horizontal plane.

8. A skate according to claim 1, further comprising:

a frame;

said attaching mechanism ensures simultaneous attachment of the frame and the rear quarter to the base.

9. A skate according to claim 1, further comprising:

a frame and a plurality of wheels attached to the frame.

10. A skate according to claim 1, wherein:

said runners of said lateral and medial sides of the lower portion of the rear quarter project outwardly from a widest area of said lower portion of the rear quarter.

11. A skate according to claim 1, wherein:

said base has a general U-shape, said upwardly extending lateral and medial edges constituting legs of said U-shape.

12. A skate according to claim 11, further comprising:

a rear strap extending over an instep girth of the user's boot; and a front strap adapted to extend over a front of the user's boot.

13. A skate according to claim 1, wherein:

said base has lateral and medial sides; and each of said upwardly extending lateral and medial edges extends longitudinally over substantially an entirety of lengths of said lateral and medial sides of said base.

14. A skate according to claim 1, wherein:

said base has lateral and medial sides; and each of said upwardly extending lateral and medial edges extends longitudinally over an entirety of lengths of said lateral and medial sides of said base.

15. A skate according to claim 1, wherein:

said medial edge of the base has a longitudinally extending central portion and said lateral edge of the base has a longitudinally extending central lateral portion;

each of said central portions of the medial and lateral edges have outer uncovered sliding surfaces for enabling a wearer to engage said sliding surfaces with other surfaces during aggressive skating.

16. A skate according to claim 1, wherein:

said rear quarter consists of a one-piece structure, said one-piece structure including a sleeve adapted to extend along lateral, medial, and posterior surfaces of the user's lower leg.

17. A skate according to claim 1, wherein:

said the rear quarter comprising a one-piece structure, said one-piece structure comprising:

an upstanding lateral member adapted to extend along a lower leg of the user;

an upstanding medial member adapted to extend along the lower leg of the user;

a lower portion extending between lower ends of said upstanding lateral and medial members and adapted to extend beneath a foot of the user.

18. A skate according to claim 1, further comprising:

a rear strap extending over an instep girth of the user's boot;

a front strap adapted to extend over a front of the user's boot;

at least said rear strap not extending beneath said base.

19. An aggressive roller skate adapted to receive a user's boot, said boot having a sole and a heel zone, said skate comprising:

a lateral side and a medial side;

a base adapted to support said boot, said base having an upwardly extending lateral edge and an upwardly extending medial edge, each of said edges including an inner surface having a longitudinal groove;

a rear quarter adapted to slide on the base and adapted to surround the heel zone of said boot, said rear quarter including a lower portion having lateral and medial sides, each of said lateral and medial sides having a longitudinally extending runner;

a mechanism to longitudinally adjust and fixedly position the rear quarter in any of a plurality of positions relative to the base;

said medial and lateral edges overlapping said lower portion of said rear quarter;

said runners of said lateral and medial sides of said lower portion of said rear quarter being slidably engaged in said grooves of said lateral and medial edges of said base;

sliding surfaces for enabling the user to slide the skate against rails and surfaces while the user is wearing the skate, said sliding surfaces extending along and not substantially above outer surfaces of said lateral edge and of said medial edge of the base;

said sliding surfaces including a rear sliding surface overlapping said lateral side of the lower portion of said rear quarter and a rear sliding surface overlapping said medial side of the lower portion of said rear quarter;

a rear strap adapted to extend over an instep girth of the user's boot, said rear strap being affixed to said rear quarter and not overlapping an outer surface of said base.

20. An aggressive in-line roller skate according to claim 19, wherein:

said sliding surfaces comprise:

a surface of a sliding shoe positioned upon a rear portion of the upwardly extending lateral edge overlapping said lower portion of said rear quarter; and a surface of a sliding shoe positioned upon a rear portion of the upwardly extending medial edge overlapping said lower portion of said rear quarter.

21. An aggressive in-line roller skate according to claim 19, wherein:

said rear quarter consists of a one-piece structure, said one-piece structure including a sleeve adapted to extend along lateral, medial, and posterior surfaces of the user's lower leg.

* * * * *